US007028843B2

(12) United States Patent
Byun

(10) Patent No.: US 7,028,843 B2
(45) Date of Patent: Apr. 18, 2006

(54) COSMETICS CASE

(76) Inventor: Young-Kwang Byun, 928-1005, Mok-dong APT, 312, Shinjeong-dong, Yangcheon-ku, Seoul 158-769 (KR)

( * ) Notice: Subject to any disclaimer, the term of this patent is extended or adjusted under 35 U.S.C. 154(b) by 15 days.

(21) Appl. No.: 10/717,656

(22) Filed: Nov. 21, 2003

(65) Prior Publication Data

US 2005/0087475 A1 Apr. 28, 2005

(30) Foreign Application Priority Data

Oct. 23, 2003 (KR) ..... 10-2003-0074166

(51) Int. Cl.
*A45D 33/36* (2006.01)

(52) U.S. Cl. ..... 206/581; 206/15.2; 132/293

(58) Field of Classification Search ..... 206/15.2, 206/15.3, 581; 132/293, 298; 220/293, 220/297, 212.5; 215/356, 357
See application file for complete search history.

(56) References Cited

U.S. PATENT DOCUMENTS

| | | | | |
|---|---|---|---|---|
| 599,775 | A * | 3/1898 | Fick | 132/293 |
| 2,679,878 | A * | 6/1954 | Stine | 220/300 |
| 2,917,766 | A * | 12/1959 | Ignatz | 206/15.2 |
| 4,446,879 | A * | 5/1984 | Gueret | 132/293 |
| 2003/0029471 | A1 * | 2/2003 | Jang | 132/293 |

* cited by examiner

*Primary Examiner*—David T. Fidei
(74) *Attorney, Agent, or Firm*—Birch, Stewart, Kolasch & Birch, LLP

(57) ABSTRACT

A cosmetics case for storing cosmetics in a powder state such as foundation product ensuring convenient and stable use thereof, which includes a receptacle shaped body formed with thresholds and a cover having hook grooves corresponding to the thresholds for connecting to the body, both the thresholds and the hook grooves being engageable together and separatable from each to allow the cover to be easily and conveniently opened and closed. In addition, the cosmetic case has a cosmetic aid fixed and integrated to the bottom portion of the cover, whereby the user can open the cover and hold a knob of the cover while at the same time conveniently applying make-up to the face.

3 Claims, 4 Drawing Sheets

COSMETICS CASE

This non-provisional application claims priority under 35 U.S.C. § 119(a) based on Patent Application No. 2003-0074166 filed in Korea on Oct. 23, 2003, the subject matter of which is herein incorporated by reference.

BACKGROUND OF THE INVENTION

1. Field of the Invention

The present invention relates to a cosmetics case for storing cosmetics in a powder state, such as a foundation product, and more particularly, to a cosmetics case including a receptacle shape of a body formed with thresholds on both sides of inner top portion of the body, a cover connected to a top portion of the body having hook grooves corresponding to the thresholds to engage together and/or separate from each other in only one direction and a sponge type cosmetic aid (=tool) coupled directly to the cover, whereby a user can hold a knob of the cover and conveniently apply make-up in a stable position.

2. Description of the Related Art

Conveniently, referring to FIGS. 4 and 5, a cosmetics case 1 for receiving cosmetics, such as foundations used to basically manage facial skin, includes a cylindrical body 10 having an inner partition 11, a cover 20 connected to the top portion of the body 10 and an additional sponge type cosmetic aid 23 positioned above the partition 11, the partition 11 storing the cosmetic 15, such as a foundation material, at bottom portion thereof.

Since the conventional cosmetics case 11 has the cover 20 and the cosmetic aid 23 individually separated, the user must firstly open the cover 20 and place the cosmetics 15 in contact with the cosmetic aids 23 additionally provided inside the case body 10, to powder her face. The user also needs to grip the cosmetic aids 23 by hand which often causes problems of staining the hands with the cosmetics and contaminating the cosmetic by touching it with the hands.

In addition, sine the cover 20 connected to the top potion of the body 10 is only in a loose-fitting status to allow the convenient use of the cosmetics case, it involves the drawback of having no structural component for connecting the body 10 and the cover 20 together and to make the cover 20 easily releasable from the body 10 while preventing the cosmetic aid 23 and/or the cosmetics contained on the body 10 from separating from the body through carelessness.

Although another structure of a cosmetics case was proposed in which the cosmetics case body is connected to the cover with screws, such a structure creates a great inconvenience in use.

SUMMARY OF THE INVENTION

It is, therefore, an object of the present invention to solve the above problems by providing a cosmetics case which is conveniently assembled and contains a cover which is detachable from the case. The cosmetic case includes a receptacle formed with thresholds on both sides of the upper potion inside the receptacle body, a cover connected to the top portion of the receptacle body having hook grooves which correspond to and engage the thresholds and/or separate therefrom in only one direction and a sponge type cosmetic aid coupled directly to the cover, whereby a user can hold the cover and conveniently apply make-up in a stable manner.

BRIEF DESCRIPTION OF THE DRAWINGS

The above object, features and advantages of the present invention will become more apparent to those skilled in the related art from the following detailed description taken in conjunction with the accompanying drawings, wherein.

DETAILD DESCRIPTION OF THE PREFERRED EMBODIMENT

The present invention will be described in more detail with reference to the following embodiments which are presented for purpose of illustration only and should not be construed to limit the scope of the present invention.

Figure 1:
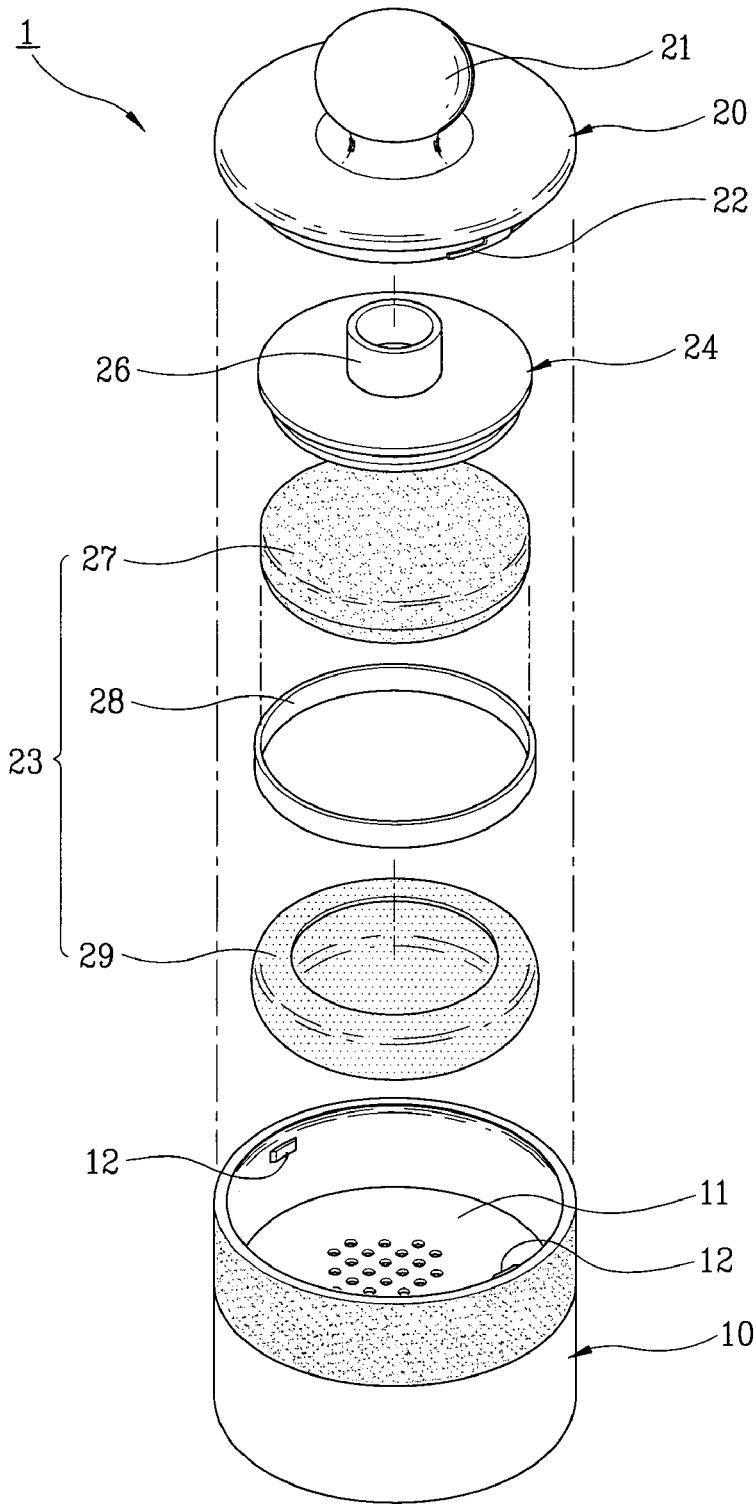
FIG. 1 is an exploded perspective view of the cosmetics case according to the present invention.
Figure 2:
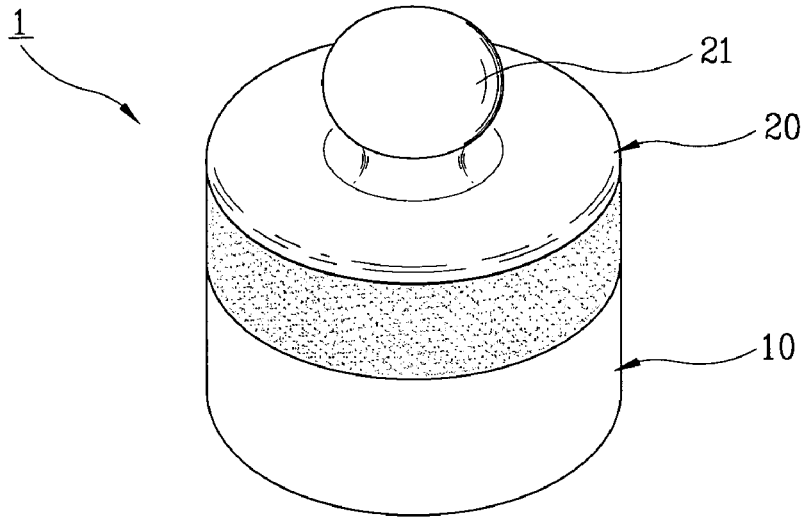
FIG. 2 is a perspective view of the cosmetics case according to the present invention, showing it in an assembled state.
Figure 3:
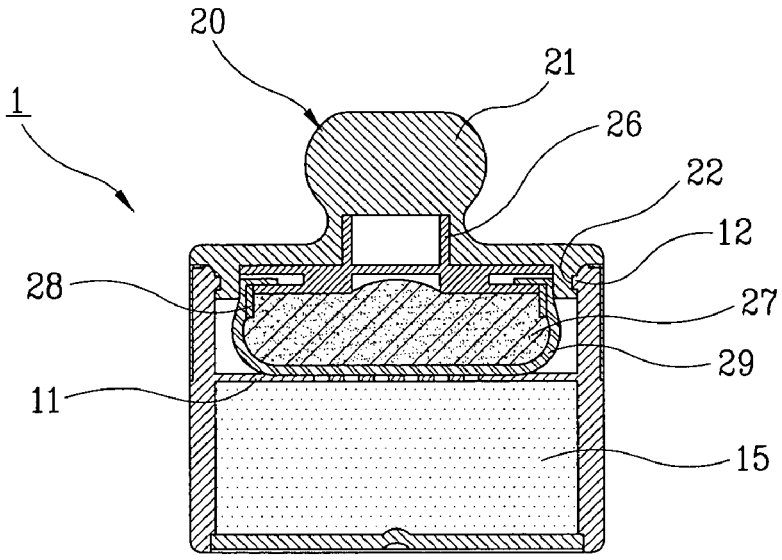
FIG. 3 is a sectional view of the cosmetics case according to the present invention, showing its assembled states.
Figure 4:
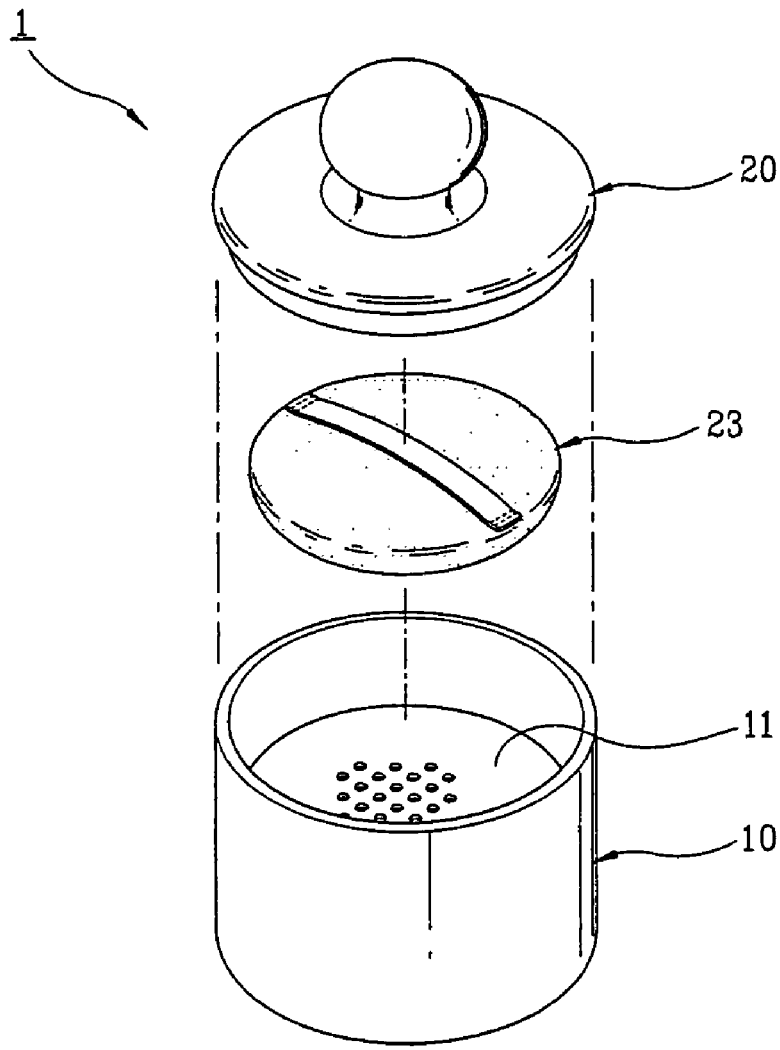
CONVENTIONAL ART FIG. 4
FIG. 4 is an exploded perspective view of a conventional cosmetics case.
Figure 5:
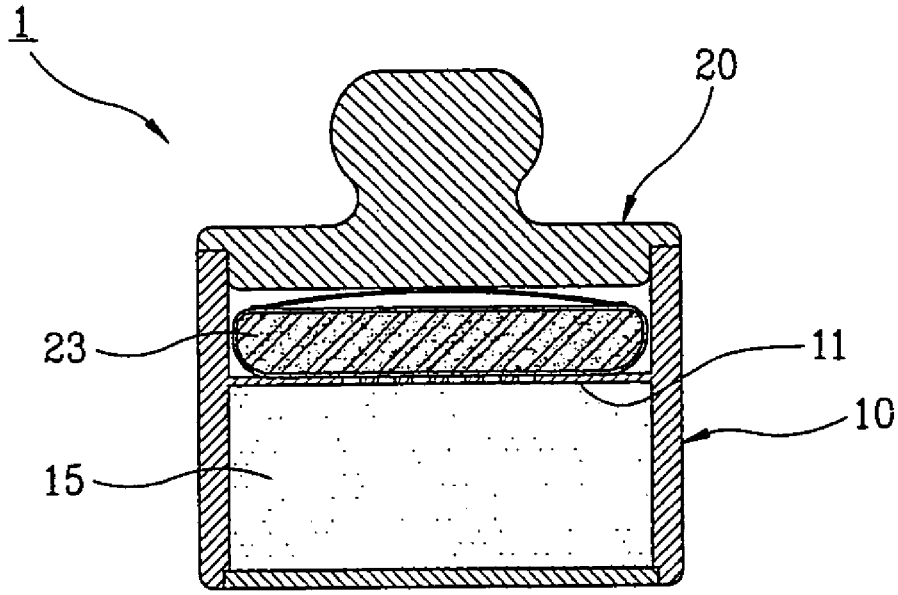
CONVENTIONAL ART FIG. 5
FIG. 5 is a sectional view of FIG. 4.

FIGS. 1 to 3 represent a preferred embodiment of the present invention. The same reference numerals are used throughout all the Figures to indicate like elements.

The cosmetics case 1, according to the present invention, has a convenient open/close mechanism between the top portion of a body 10 and a cover 20. Thus, thresholds 12 are formed in two positions on both sides of the inner surrounding wall of the body 10 and two removable hook grooves 22 corresponding to the above thresholds 12 are formed in two positions on the outer surrounding wall of the cover 20, the hook grooves 22 being dimpled in only one direction to allow the thresholds 12 to be assembled and released from the grooves 22 in the only one direction.

The cover 20 has a fixing member 24 fitted inside a knob 21 by a fitting member 26 in order to secure the cosmetic aids 23 to the cover 20. A sponge type flexible body 27 and a flexible cover 29 together fixed and connected to the cover 20 by a ring type holder 28, all from part of the cosmetic aids 23.

Such construction of the cosmetics case 1 according to the present invention has the benefit to easily and conveniently open/close the cover 20 by a simple connection between the thresholds 12 and the hook grooves 22 which are formed on the inner side of the body 10 and on the outer surrounding wall of the cover 20, respectively, and assembled together and released from each other to open and close the cover 20, whereby it can be used for application to the user's face.

Additionally, the cosmetic aid 23 is integrated with the cover 20 by the fixing member 24 and the holder 28 at bottom portion of the cover 20, whereby the user can open the cover 20 and hold the knob 21 of the cover 20 simultaneously and then apply make-up when using the cosmetics case 1.

As described in detail above, the cosmetics case according to the present invention includes a body and a cover to be assembled and disassembled using thresholds and hook grooves which are formed on the inner side of the body and on the outer surrounding wall o the cover, respectively, to attain the convenient opening and closing thereof. In addition, since the cosmetic aid is directly coupled to the cover, the user can hold the cover and apply cosmetics to the face in a stable position. Further, because the user holds the knob of the cover to powder the face, convenience of application is great enhanced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cosmetics case comprising:

a case body provided with a knob and formed with thresholds protruding from two positions inside the body on both sides of an upper portion thereof;

a cover formed with hook-engaging grooves corresponding to the thresholds at two peripheral positions on the outer surrounding wall of the cover;

a fixing member fitted inside the knob and secured to the bottom portion thereof; and a cosmetic aid fixed to and integrated with the cover by a ring type holder provided at the bottom portion of the fixing member.

2. The cosmetics case of claim 1, wherein the hook grooves are formed to define a slot in only one direction to allow the thresholds to be assembled with and released from said slot in said one direction, and both the hook grooves and the thresholds are formed in two positions, outside the cover and inside the body, respectively.

3. The cosmetics case of claim 1, wherein the cosmetic aid is replaceably secured to the cover.

* * * * *